US006872899B2

(12) United States Patent
Oshio et al.

(10) Patent No.: US 6,872,899 B2
(45) Date of Patent: Mar. 29, 2005

(54) LOCKABLE PUSHBUTTON ACTUATOR FOR A DISPLAY DEVICE SUCH AS A WATCH

(75) Inventors: Takumi Oshio, Taikoo Shing (HK); Kowk Fai Lam, Lok Fu (HK)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/813,438

(22) Filed: Mar. 31, 2004

(65) Prior Publication Data

US 2004/0256205 A1 Dec. 23, 2004

(30) Foreign Application Priority Data

Mar. 31, 2003 (JP) ..... 2003-097495
Mar. 17, 2004 (JP) ..... 2004-076591

(51) Int. Cl.[7] ..... H01H 3/12; H01H 9/28; G04B 29/00

(52) U.S. Cl. ..... 200/43.13; 200/341; 368/319

(58) Field of Search ..... 200/43.11–43.13, 200/308–314, 341–345; 368/308, 319, 320, 321

(56) References Cited

U.S. PATENT DOCUMENTS 3,389,550 A * 6/1968 Piquerez ..... 368/308
3,974,351 A * 8/1976 Solov et al. ..... 200/345
4,313,187 A * 1/1982 Waki et al. ..... 368/319
5,043,958 A * 8/1991 Kaelin ..... 368/319 X
5,383,166 A * 1/1995 Gallay ..... 368/319 X
6,137,750 A * 10/2000 Rieben ..... 368/319 X

FOREIGN PATENT DOCUMENTS

JP 2003-7164 A 1/2003

* cited by examiner

*Primary Examiner*—James R. Scott
(74) *Attorney, Agent, or Firm*—Shinjyu Global IP Counselors, LLP

(57) ABSTRACT

There is provided a button capable of entry and exit with respect to a base. The button has a button member, ring member, lock member, and fixed member. The button member has a shaft portion mounted in a manner that allows entry and exit with respect to the base, and an expanded-diameter portion with a shaft diameter that is larger than the diameter of the shaft portion. The ring member accommodates the shaft portion and can rotate about the axial center of the shaft portion. The lock member moves along the axial center between the ring member and the shaft portion due to the rotation of the ring member, and restricts the entry and exit action of the button member by coming into contact with the expanded-diameter portion of the button member. The fixed member is fixed to the base and stops the ring member to restrict the movement of the ring member along the axial center.

23 Claims, 13 Drawing Sheets

LOCKABLE PUSHBUTTON ACTUATOR FOR A DISPLAY DEVICE SUCH AS A WATCH

BACKGROUND OF THE INVENTION

1. Field of the Invention

The present invention relates to a button and to portable equipment provided therewith, and more particularly to a button suitable to be installed in watches and other portable equipment.

2. Description of the Related Art

Operating buttons are commonly disposed on the external surface of a main body of a wristwatch, pocket watch, or other portable watch; or a stopwatch, dive computer, or other type of portable equipment. In such an operating button, the button member is normally mounted to protrude slightly from the external surface of the main body in a manner that allows entry and exit with respect to the base, and is configured so that the contact or the like within the main body operates by pressing this button member. Also, a lock mechanism for restricting the thrust action of the button member has been proposed for preventing operating button malfunctions (JP-A 2003-7164).

The operating button with a lock mechanism cited in JP-A 2003-7164 is provided with the configuration described below. In other words, a cylindrical fixed member (tube member) is inserted through and fixed in a through-hole disposed in the base (body), and the shaft portion of the button member is slidably inserted in the axial direction through the fixed member. In the button member, a head portion with an expanded-diameter portion is mounted on the external end of the shaft portion, and an elastic member having a coil spring is housed in a compressed manner between the head portion and the fixed member. A restricting surface facing in the external axial direction is provided in the form of a stepped cylinder to the shaft portion of the button member, and a lock member whose internal peripheral surface threadably engages the fixed member is inserted therethrough.

An operating button with a lock mechanism in such a configuration is constituted such that when the head portion of the button member is pressed with the fixed member threadably inserted deep into the base, the button slides in the axial direction so that the button member enters the base while compressing the elastic member, causing a contact or the like disposed inside the base to operate. Also, the configuration is such that when the lock member is rotated and withdrawn, the movement of the button member is restricted by the restricting surface of the lock member coming into contact with the inside of the head portion of the button member, preventing the button member from being unintentionally pressed by operational error.

However, there is a drawback in the operating button cited in JP-A 2003-7164 in that the lock member is required to be withdrawn to restrict the movement of the button member and the external appearance of the operating button differs in terms of the locked state and the unlocked state, resulting is a flawed design.

There is a further drawback in that by repeatedly rotating and pulling out or threadably inserting the externally exposed lock member, foreign matter or the like tends to enter in between the lock member and the base of the fixed member, and time is needed to keep the lock member in operating order.

In view of the above, it is apparent to those skilled in the art from the disclosure of the present invention that a need exists for an improved button. The present invention is one that provides for these requirements in the prior art, as well as for other requirements that will be made apparent to those skilled in the art through the following disclosure.

SUMMARY OF THE INVENTION

An object of the present invention is to provide a button that allows the design of the external appearance to be improved, and the maintenance requirements to be reduced.

A button related to the present invention is one that is capable of entry and exit with respect to the base. The button has a button member, a ring member, a lock member, and a fixed member. The button member has a shaft portion mounted in a manner that allows entry and exit with respect to the base, and an expanded-diameter portion with a shaft diameter that is larger than the diameter of the shaft portion. The ring member with the shaft portion inserted therethrough is capable of rotating about the axial center of the shaft portion. The lock member moves along the axial center between the ring member and the shaft portion by the rotation of the ring member, and restricts the entry and exit action of the button member by coming into contact with the expanded-diameter portion of the button member. The fixed member is fixed to the base and stops the ring member to restrict the movement of the ring member along the axial center.

Another button related to the present invention has a button member, a lock member, and a fixed member. The button member has a shaft portion mounted in a manner that allows entry and exit with respect to the base, an expanded-diameter portion with a shaft diameter that is larger than the diameter of the shaft portion, and a cylindrically shaped portion that extends to the external end of the expanded-diameter portion and is disposed surrounding the shaft portion. The lock member has an internal peripheral portion through which the shaft portion is inserted in a manner that allows relative movement along the axial center of the shaft portion between the shaft portion and the cylindrically shaped portion, and an external peripheral portion that threadably engages the internal periphery of the cylindrically shaped portion of the button member. The fixed member is fixed to the base, and supports the lock member in a manner that allows relative movement along the axial center but does not allow relative rotation about the axial center. The fixed member restricts the entry and exit action of the button member such that the lock member moves along the axial center due to the rotation of the button member, and the lock member makes contact therewith.

Yet another button related to the present invention has a button member, a lock member, and a fixed member. The button member has a shaft portion mounted in a manner that allows entry and exit with respect to the base, an expanded-diameter portion with a shaft diameter that is larger than the diameter of the shaft portion, and a cylindrically shaped portion that extends to the external end of the expanded-diameter portion and is disposed surrounding the shaft portion. The lock member has an internal peripheral portion through which the shaft portion is inserted in a manner that allows relative movement along the axial center of the shaft portion between the shaft portion and the cylindrically shaped portion, and an external peripheral portion disposed in a manner that does not allow relative rotation but allows relative movement along the axial center with respect to the cylindrically shaped portion of the button member. The fixed member is fixed to the base, and threadably engages the external peripheral portion of the lock member. The fixed member restricts the entry and exit action of the button member such that the lock member moves along the axial center due to the rotation of the button member, and the lock member makes contact therewith.

The portable equipment related to the present invention has a portable equipment main body and a button related to the present invention as described above.

The objects, characteristics, advantages, and other features of the present invention as described above will be apparent to those skilled in the art through the description of the present invention provided below. Disclosed in the description of the present invention below are the appended diagrams as well as the preferred embodiments of the present invention.

BRIEF DESCRIPTION OF THE DRAWINGS

The appended diagrams constituting a portion of the disclosure of the present invention are described below.

DESCRIPTION OF THE PREFERRED EMBODIMENTS

Embodiments of the present invention are described below with reference to the diagrams. It is apparent to those skilled in the art that the description related to the working examples of the present invention are for the purpose of describing the present invention and do not limit the present invention defined by the hereinafter described claims and equivalents thereof.

In the second embodiment and embodiments thereafter that are described below, the same symbols are applied to the same components and to components having the same functions as the constituent parts in the first embodiment described below, and the description is simplified.

(First Embodiment)

The button structure related to the first embodiment of the present invention is described below based on FIGS. 1 to 4.

The button structure of the present embodiment is one of an operating button 10 disposed on a external surface of a main body of a wristwatch, pocket watch, or other portable watch; or a stopwatch, dive computer, or other type of portable equipment.

Figure 1:
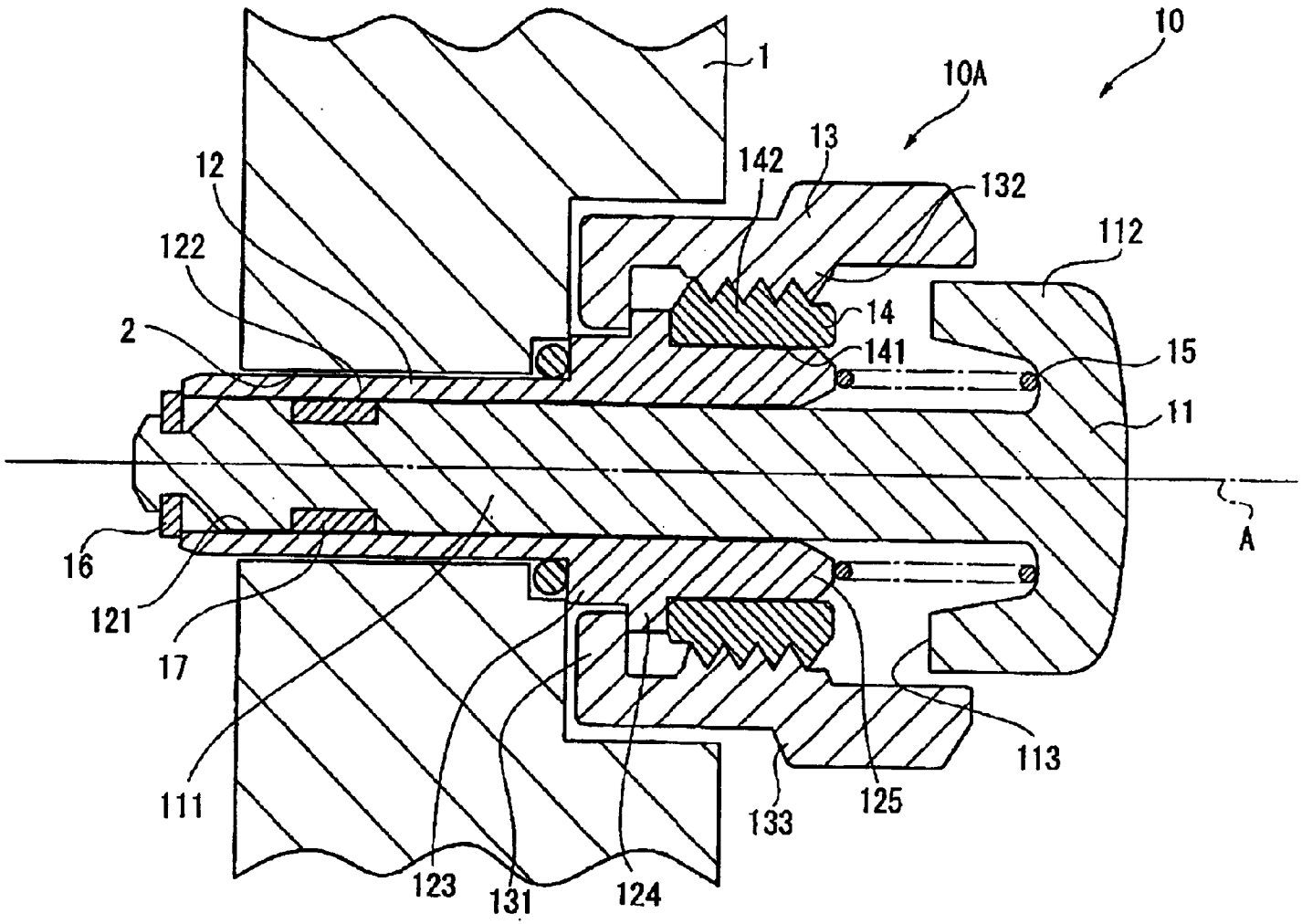
FIG. 1 is a cross-sectional view showing an operating button in accordance with a first embodiment of the present invention in an unlocked state.
Figure 2:
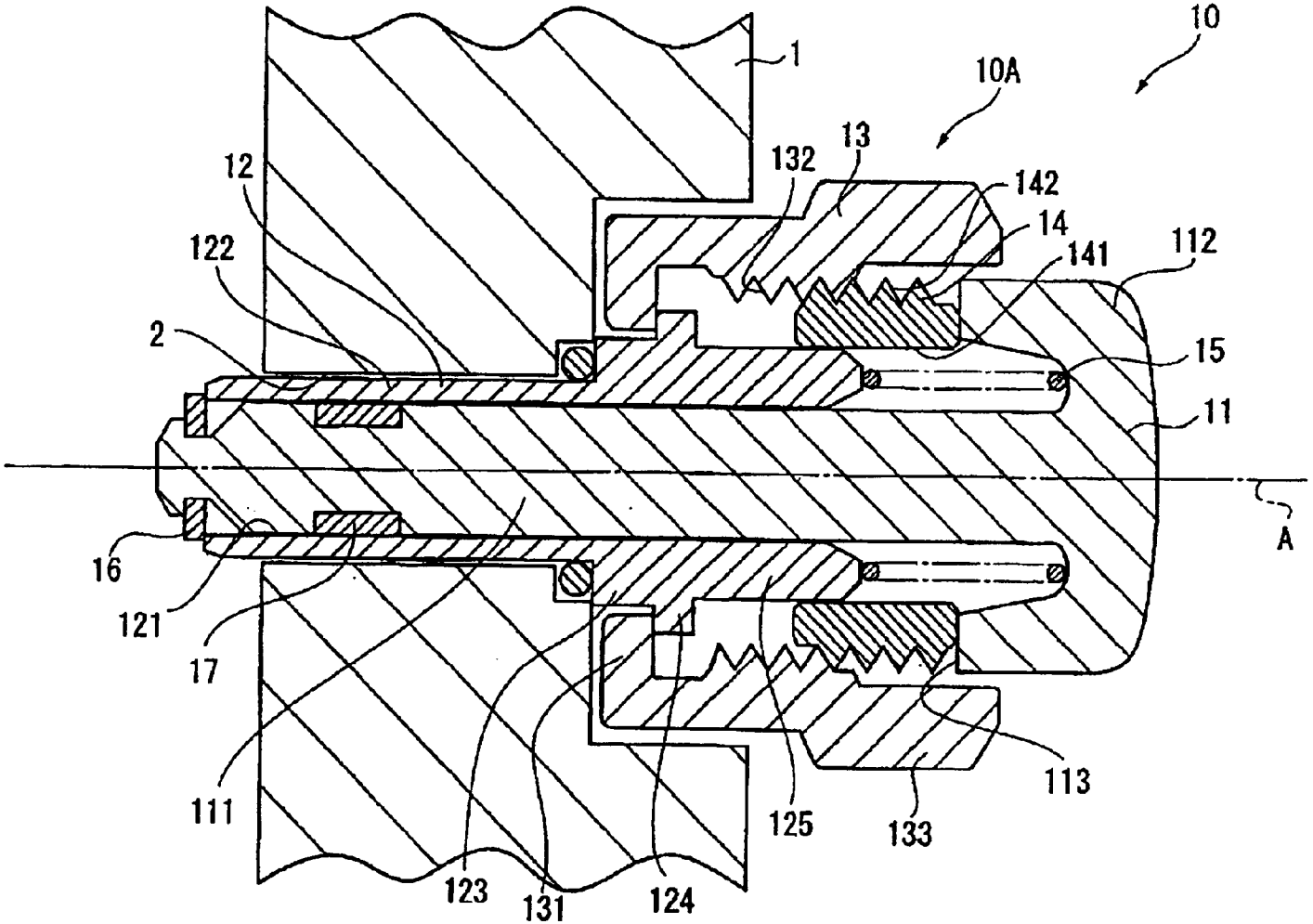
FIG. 2 is a cross-sectional view showing the locked state of the operating button.
Figure 3:
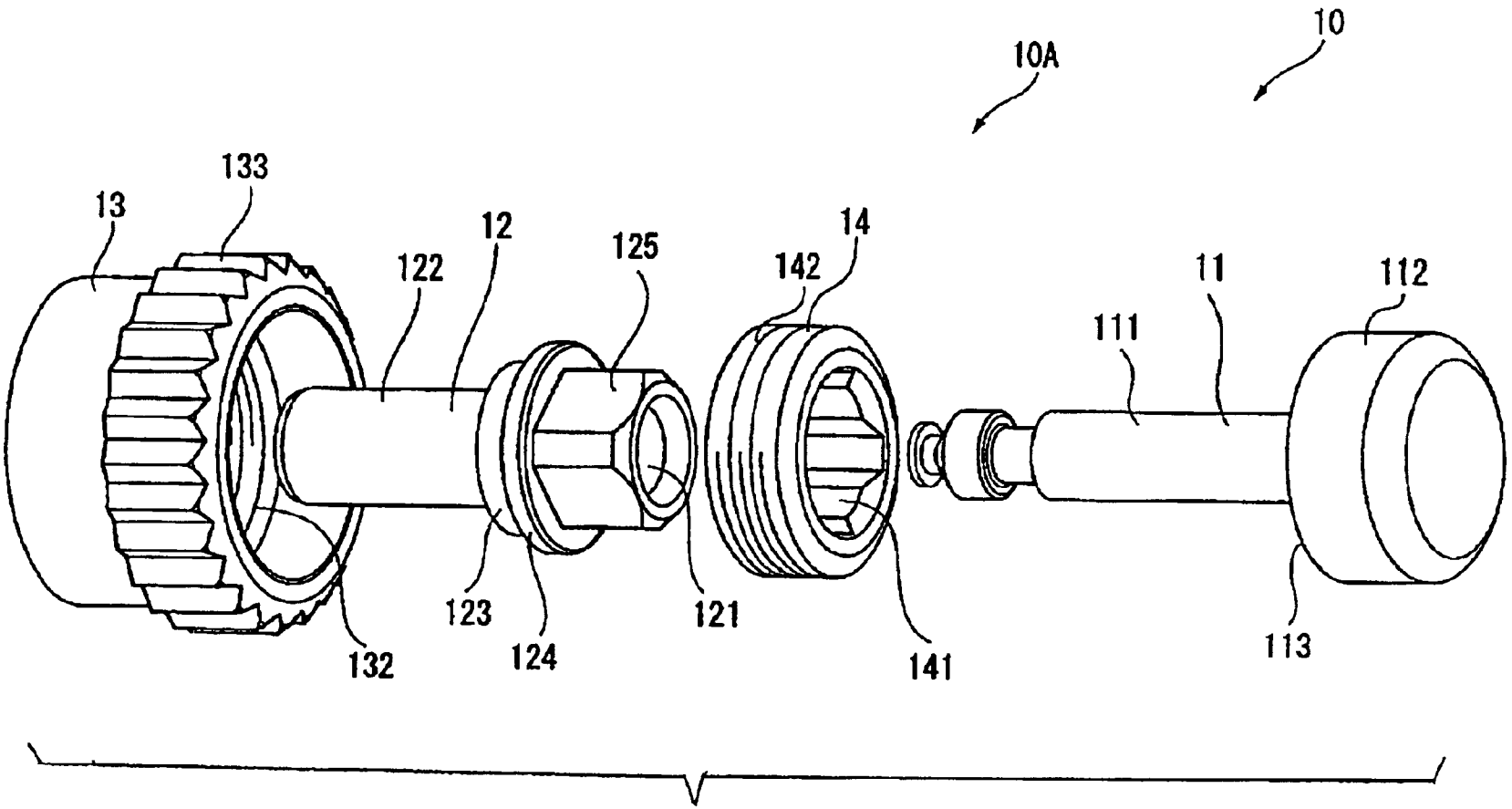
FIG. 3 is an exploded perspective view of the operating button.
Figure 4:
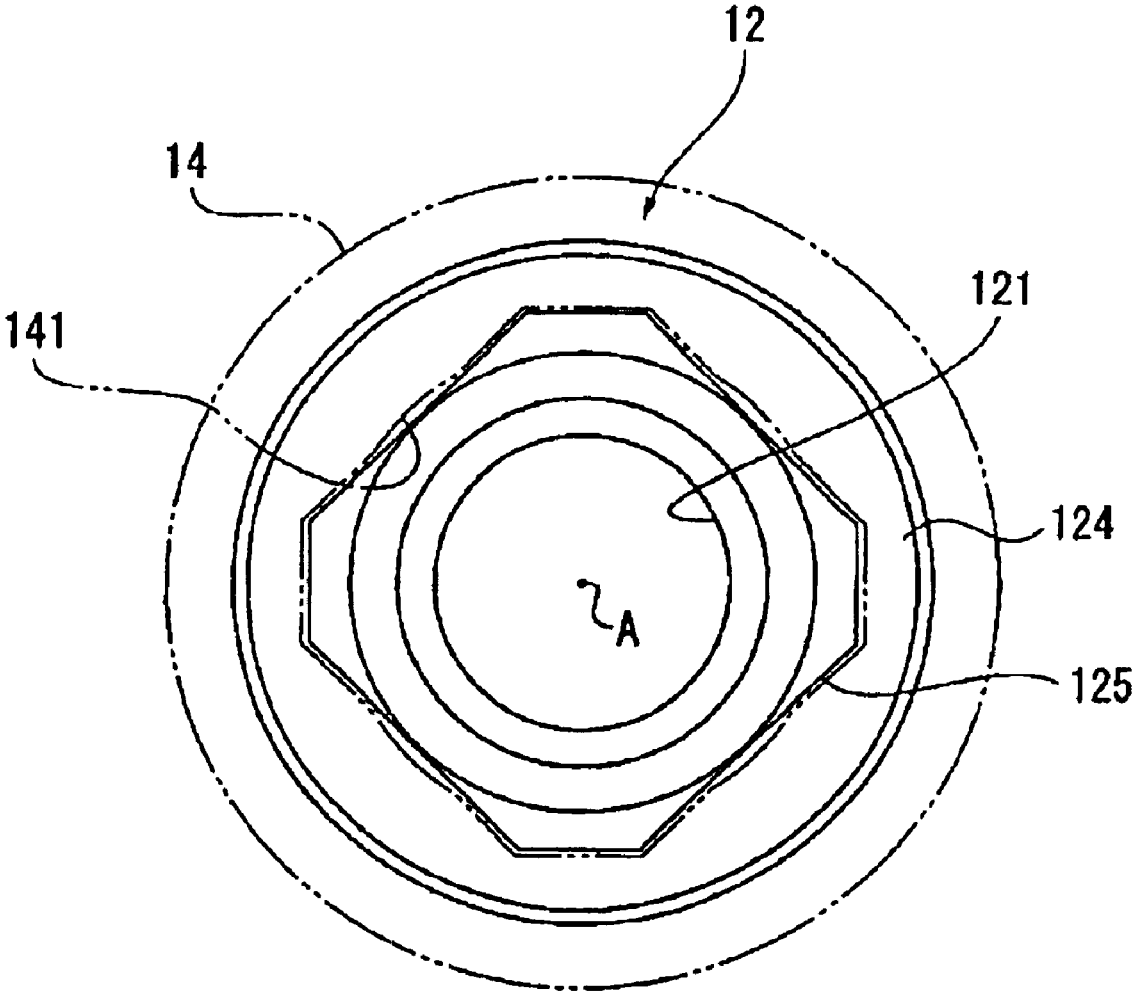
FIG. 4 is a side view showing the essential portions of the operating button.

FIGS. 1 and 2 show the operating button 10 and are cross-sectional views that illustrate the unlocked and locked states, respectively. FIG. 3 is an exploded perspective view of the operating button 10. FIG. 4 is a side view showing the essential portions of the operating button 10, and is a side view of a hereinafter-described fixed member 12.

In FIGS. 1 to 4, a case 1 serving as the casing forms the external shell of portable equipment (the main body of the portable equipment), and houses drive mechanisms, power sources, computing units, display units, and other components (not depicted). The operating button 10 is disposed inside and outside a through-hole 2 formed in the internal-external direction (left and right directions in FIGS. 1 and 2) of the case 1, and is configured to allow pressing operation from the exterior to activate the contact point (not depicted) inside the case 1.

The operating button 10 includes a button member 11 disposed in a manner that allows reciprocating movement along the internal-external direction of the case 1, a fixed member 12 fixed to the through-hole 2 of the case 1, a ring member 13 disposed to encompass the button member 11 on the outside of the case 1 and configured to allow rotating operation, and a lock member 14 disposed between the ring member 13 and the fixed member 12. There is also a lock mechanism 10A for preventing the operating button 10 from being caused to malfunction by these members. The operating button 10 is further provided with a coil spring 15 that serves as an elastic member for urging the button member 11 in a direction to protrude from the case 1.

The button member 11 is formed having a long, cylindrically shaped shaft portion 111 disposed in a manner that allows entry and exit along the through-hole 2, and a head portion 112 serving as an expanded-diameter portion in which the shaft diameter is expanded in the direction intersecting the axial center A on the external end along the axial center A of the shaft portion 111. The head portion 112 is formed such that the cross section is substantially a concave shape in which the external peripheral portion is bent toward the case 1, and the end face thereof next to the case 1 forms a contact surface 113 that comes into contact with the lock member 14.

The fixed member 12 is formed such that the entire member has a substantially cylindrical shape, and an insertion hole 121 extending in the internal-external direction along the through-hole 2 of the case 1 is formed in the lengthwise direction thereof. The shaft portion 111 of the button member 11 is inserted from the outside into the insertion hole 121, and a stopper pin 16 is mounted on the tip of the shaft portion 111 protruding into the case 1. The stopper pin 16 is an E ring, for example, and is configured to prevent the button member 11 from slipping out by coming into contact with the internal end of the fixed member 12 on the side of the case 1. A waterproofing seal material 17 is disposed between the insertion-hole 121 and the shaft portion 111.

The fixed member 12 has an insert 122 that is inserted into the through-hole 2, and the fixed member 12 is configured to be difficult to remove from the case 1 by press-fitting the fixed member 122 into the through-hole 2 with a predetermined pressing force. A fixed portion 123 with a shaft diameter greater than the internal diameter of the through-hole 2 is formed on the outside of the insert 122. This fixed portion 123 is fixedly soldered to the external end portion of the through-hole 2, the fixed member 12 is prevented from rotating about the axial center A by the fixed soldering, and water or the like is prevented from entering between the through-hole 2 and the insert 122. A stopper portion 124 with a shaft diameter greater than that of the fixed member 123 is formed on the outside of the fixed member 123, and is configured to allow the ring member 13 to catch between the stopper portion 124 and the case 1. Furthermore, a guide portion 125 whose cross section is substantially an angular column is formed toward the external end of the fixed member 12, as shown in FIG. 4, and is configured to allow the lock member 14 to be guided in the internal-external direction along this guide portion 125.

The ring member 13 is formed such that the entire member has a substantially cylindrical shape whose internal diameter is sufficient to allow the button member 11, lock member 14, and fixed member 12 to be inserted into the interior thereof. A stopped portion 131 that allows the fixed portion 123 of the fixed member 12 to be inserted but does not allow the stopper portion 124 to be inserted is disposed on the ring member 13 on the side facing the case 1 in the internal-external direction. This stopped portion 131 is stopped between the external surface of the case 1 and the stopper portion 124 of the fixed member 12, and movement is restricted in the internal-external direction of the ring member 13. The external end portion in the internal-external direction of the ring member 13 is open to allow the head portion 112 of the button member 11 to be inserted, and the head portion 112 is configured to enter the ring portion 13 by pressing the button member 11. A threaded portion 132 for threadably engaging the external peripheral surface of the lock member 14 is formed on the internal peripheral surface of the ring member 13. A knurl 133 serving as a brace during rotation operation is formed on the external peripheral surface of the ring member 13.

The lock member 14 is formed in the shape of a ring as a whole, and an angular hole 141 formed in the internal peripheral surface thereof slidably engages with the guide portion 125 of the fixed member 12 in the internal-external direction. In other words, the rotational movement of the lock member 14 about the axial center A is restricted by engagement of the angular hole 131 thereof with the angular guide member 125 of the fixed member 12. A threaded portion (external peripheral portion) 142 for threadably engaging the threaded portion 132 of the ring member 13 is formed on the external peripheral surface of the lock member 14. Therefore, due to the mutual engagement of the threaded portions 132 and 142, the lock member 14 is configured to reciprocate in the internal-external direction along the axial center A when the ring member 13 is rotationally operated, and if the rotation of the ring member 13 is stopped, movement is restricted. The lock member 14 is capable of moving between the unlocked position in which the surface that corresponds to the internal end in the internal-external direction has been brought into contact with the stopper portion 124 of the fixed member 12, as shown in FIG. 1, and the locked position in which surface that corresponds to the external end has been brought into contact with the contact surface 113 of the button member 11, as shown in FIG. 2.

The coil spring 15 is insertably mounted around the shaft portion 111 of the button member 11, one end making contact with the depressed portion of the concave shape of the head portion 112, and the other end making contact with a surface that corresponds to the external end of the fixed member 12. The coil spring 15 is mounted in a predetermined compressed state, and is constantly urging the button member 11 in the direction away from the case 1. Furthermore, the assembly is configured so that a pressing operation of the button member 11 compresses the coil spring 15 to generate a greater urging force, and the button member 11 is returned to its initial position by the urging force if the pressing operation is released.

The assembly procedure of the operating button 10 described above is described below.

First, the ring member 13 is inserted around the fixed member 12 from the insert 122, and the stopped portion 131 of the ring member 13 is stopped by the stopper portion 124 of the fixed member 12. In this state, the insert 122 of the fixed member 12 is press-fitted into the through-hole 2 of the case 1, and fixed by soldering the fixed portion 123 and the external peripheral portion of the through-hole 2.

Next, the lock member 14 is set in a state in which the angular hole 141 thereof engages the guide portion 125 of the fixed member 12, and the lock member 14 is moved in the direction of the case 1 by the rotating operation of the ring member 13.

The shaft portion 111 of the button member 11 around which the coil spring 15 has been inserted is inserted into the insertion hole 121 of the fixed member 12, the button member 11 is pressed against the urging force of the coil spring 15 to cause the shaft portion 111 to protrude into the case 1, and the stopper pin 16 is mounted on the tip of the shaft portion 111.

The operating button 10 is mounted in the through-hole 2 of the case 1 with the procedure described above.

The following effects are obtained in accordance with the present embodiment described above.

(1) The lock member 14 configured to be capable of moving along the axial center A by the rotating operation of the ring member 13 is disposed on the inside of the ring member 13, and the head portion 112 of the button member 11 is disposed in close contact with the external end of the ring member 13, so the lock member 14 is not externally exposed, the external appearance of the operating button 10 does not change in the locked or unlocked state, and the design of the external appearance can be improved.

(2) The lock member 14 is not externally exposed, so foreign matter or the like does not enter the interior of the ring member 13 in association with the movement of the lock member 14, ease of operation can be maintained, and maintenance requirements can be eased.

(3) The ring member 13 is stopped by the stopper portion 124 of the fixed member 12, and movement in the internal-external direction is restricted, so the ring member 13 can be rotationally operated without rattling and the lock member 14 can be smoothly moved.

(4) The ring member 13 has been configured to catch on the stopper portion 124 of the fixed member 12 that has been press-fitted and fixed inside the through-hole 2 of the case 1, whereby the fixed member 12 can be press-fitted in the case 1 while the ring member 13 is secured during assembly, less work is required, and the work efficiency can be improved in comparison with mounting the ring member 13 afterward.

(5) The button can be operated with greater ease because when the button member 11 is pressed and then released, this button member 11 immediately returns to its initial position as a result of the fact that this button member 11 is urged by the coil spring 15.

(6) As a result of the fact that the coil spring 15 is housed between the head portion 112 of the button member 11 and the fixed member 12, the coil spring 15 does not vary in its extension and compression even if the lock member 14 moves, and the force required for rotating the ring member 13 does not vary, so better operability can be achieved.

(7) The lock member 14 threadably engages the ring member 13, and the rotating operation of the lock member 14 is restricted by the fixed member 12, so the lock member 14 can be reliably rotated by rotation of the ring member 13.

(8) The lock member 14 threadably engages the ring member 13, so if the rotation of the lock member 14 is stopped, the movement of the lock member 14 can be reliably restricted and the locked and unlocked states can be adequately maintained due to the mutual engagement of the threaded portions 132 and 142.

(Second Embodiment)

Figure 5:
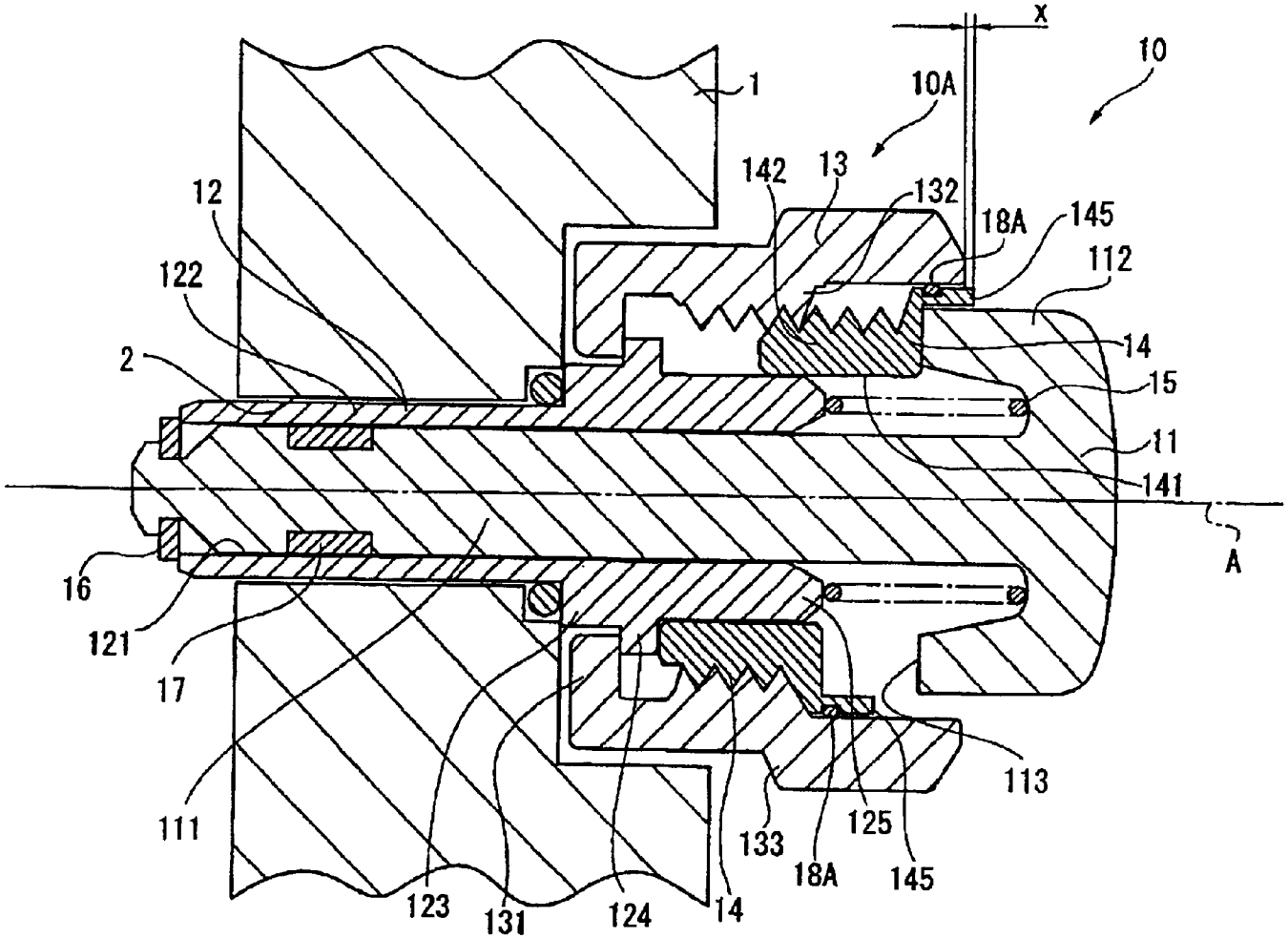
FIG. 5 is a cross-sectional view showing an operating button in accordance with a second embodiment of the present invention.
Figure 6:
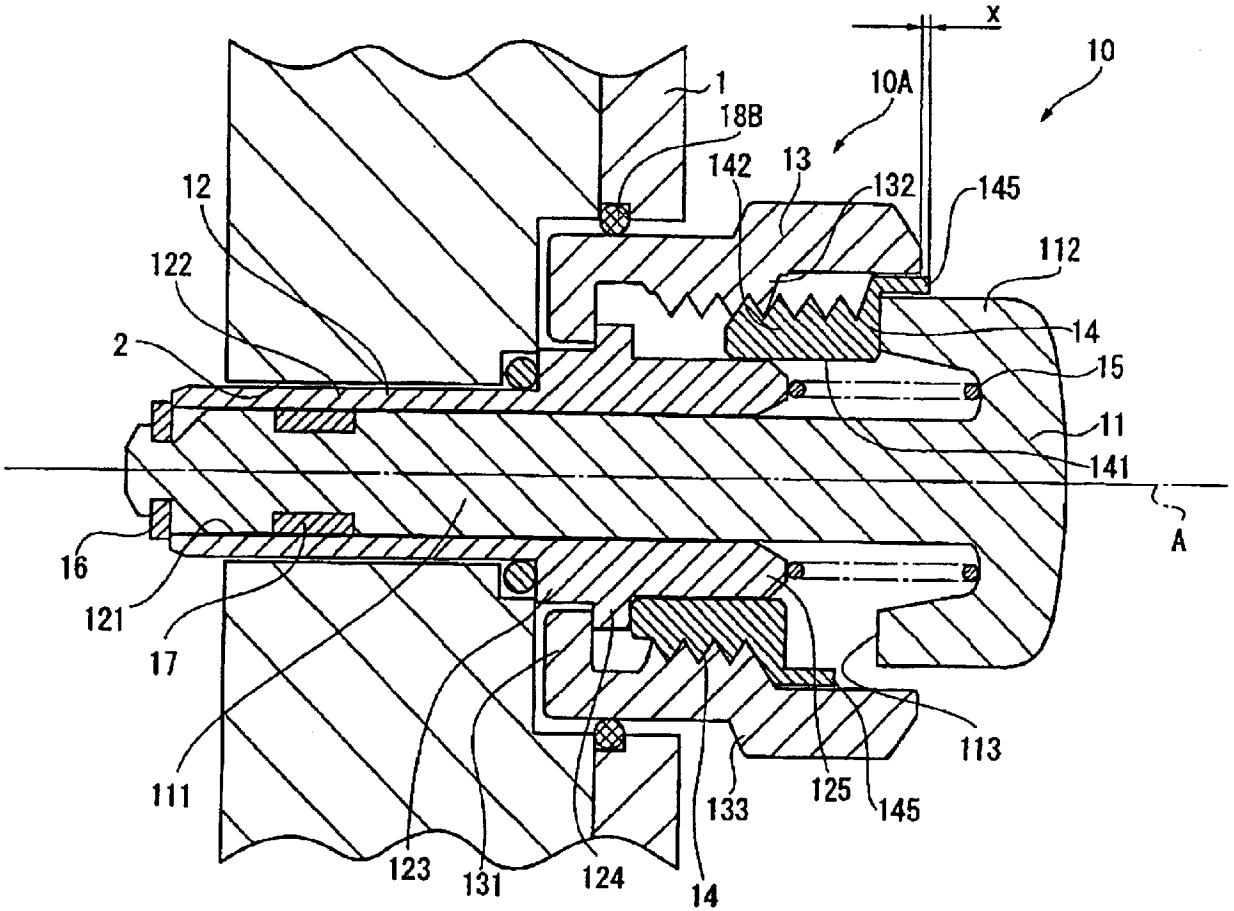
FIG. 6 is a cross-sectional view showing a modification of the operating button.
Figure 7:
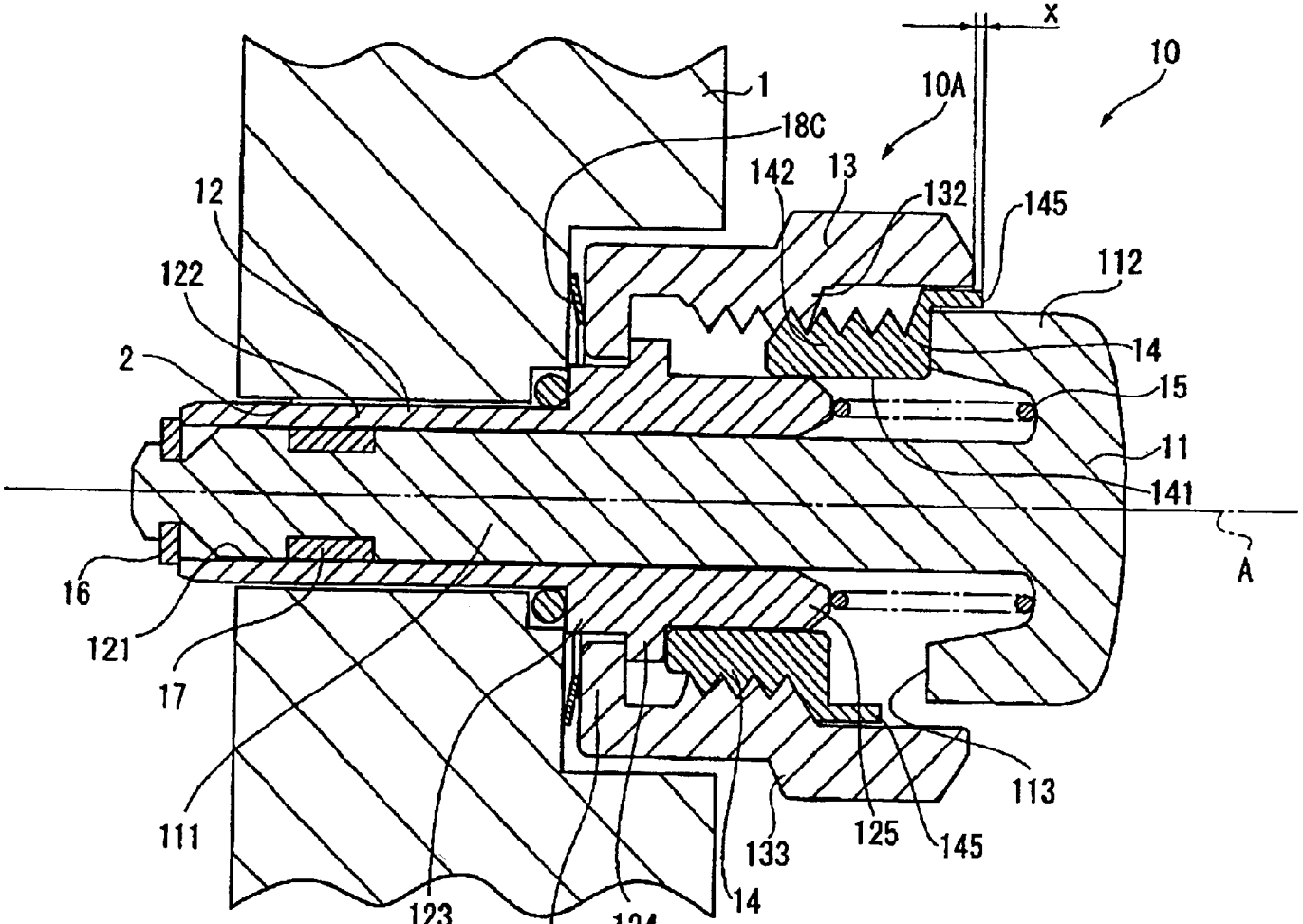
FIG. 7 is a cross-sectional view showing a modification of the operating button.

Next, the button structure related to the second embodiment of the present invention is described based on FIGS. 5 to 7.

The button structure of the present invention has substantially the same configuration as the operating button 10 in the above-described first embodiment, but differs in that the shape of the lock member 14 is different and a restricting member is provided. These differences are described in detail below.

FIG. 5 is a cross-sectional view showing the operating button 10 of the present embodiment, the area above the axial center A shows a locked state, and the area below the axial center A shows an unlocked state.

In FIG. 5, the lock member 14 protrudes toward the head portion 112 of the button member 11, and has a locked state indicator 145 formed in the shape of a ring about axial center A. When locked, a locked state indicator 145 protrudes by an amount equal to the dimension x away (right side of the diagram) from the gap between the head portion 112 of the button member 11 and the ring member 13, providing visual confirmation from the outside of the operating button 10. When in an unlocked state (the state in the lower area of FIG. 5), the locked state indicator 145 is housed in the interior of the ring member 13, and is not visible from outside the operating button 10. It can thereby be determined whether the button member 11 is in a locked state or in an unlocked state.

The locked state indicator 145 is not required to protrude outside from the space between the head portion 112 and the ring member 13 of the button member 11. In other words, even if the locked state indicator 145 does not protrude, it has only to move to a position from which it can be viewed from the outside of the operating button 10.

Moreover, packing material 18A as a restricting member is disposed between the locked state indicator 145, in other words, the ring member 13, and the lock member 14. The packing material 18A is a ring formed from rubber or other elastic material, and is fitted into the groove portion of the external peripheral surface of locked state indicator 145. The packing material 18A is in contact with the inside of the ring member 13, and is configured to add frictional resistance to the ring member 13 and to restrict the rotational movement thereof. For this reason, the ring member 13 does not rotate due to vibrations or other external factors; that is to say, the lock member 14 is prevented from becoming loosened from the locked state, or becoming locked from the unlocked state. Also, the lock member 14 is configured so as to be capable of moving back and forth between the locked position and the unlocked position when the ring member 13 is rotationally operated, as described above, because the packing material 18A slides in contact with the internal peripheral surface of the ring member 13 due to the operation of the ring member 13 against this frictional resistance.

The button structure of the present embodiment is not limited to the structure shown in FIG. 5, and also possible are the structures shown in FIGS. 6 and 7 below.

FIGS. 6 and 7 are cross-sectional diagrams showing the operating button 10 related to modifications of the present embodiment; the area above the axial line A shows a locked state, and the area below the axial line A shows an unlocked state.

In FIG. 6, packing material 118B serving as a restricting member is disposed between the case 1 and the external peripheral surface of the ring member 13, and the packing material 18B adds frictional resistance to the ring member 13 and restricts the rotational movement thereof. Therefore, the movement of the lock member 14 can be restricted in the same manner described above.

The position in which the packing materials 18A and 18B are disposed is not limited to the above description, and these may be disposed between the case 1 and the bottom surface of the ring member 13 (left-side surface in the diagram), between the ring member 13 and the fixed member 12, or between the interior surface of the angular hole 141 of the lock member 14 and the fixed member 12.

In FIG. 7, a spring member 18C serving as a restricting member is disposed between the case 1 and the bottom surface of the ring member 13 (left-side surface in the diagram). The spring member 18C, which has a coned disc spring and a spring washer or the like, urges the ring member 13 inward (right side in the diagram) with respect to the case 1.

The spring member 18C is configured to urge the ring member 13, to generate frictional resistance in the portion where the ring member 13 and the lock member 14 threadably engage, and to restrict the rotational movement and the reciprocating movement of these. The loosening of the lock member 14 can thereby be prevented. The lock member 14 is configured to be capable of moving back and forth between the locked and unlocked positions when the ring member 13 is rotationally operated against the urging force of the spring member 18C.

In addition to the above-described effects (3) to (8), the following effects are obtained in accordance with the present embodiment described above.

(9) In other words, the locked state indicator 145 of the lock member 14 is exposed only enough to enable external visual confirmation, so the external appearance of the operating button 10 in the locked and unlocked states is not significantly changed, and the design of the external appearance can be improved. The design of the external appearance of the operating button 10 can also be improved and the exposed locked state indicator 145 can become a feature of the of the design by coloring the locked state indicator 145, and giving a different surface finish to the head portion 112 of the button member 11 and the ring member 13.

(10) A gap sufficient to allow external visual confirmation of the locked state indicator 145 needs only to be provided between the head portion 112 of the button member 11 and the ring member 13, and the size of this gap can be made sufficiently small, so foreign matter or the like does not easily enter the interior of the ring member 13, ease of operation can be maintained, and maintenance requirements can be eased.

(11) Furthermore, it can immediately be determined whether the button member 11 is in the locked or unlocked state by visually confirming the locked state indicator 145 of the lock member 14, and convenience can be improved.

(12) Moreover, the lock member 14 can be prevented from unexpectedly coming loose due to vibrations or other factors while in service by restricting the rotational movement of the ring member 13 and the rotational and reciprocating movement of the lock member 14 by the spring member 18C and the packing materials 18A and 18B, which are restricting members, and the locked and unlocked states of the button member 11 can be properly maintained.

(Third Embodiment)

Figure 8:
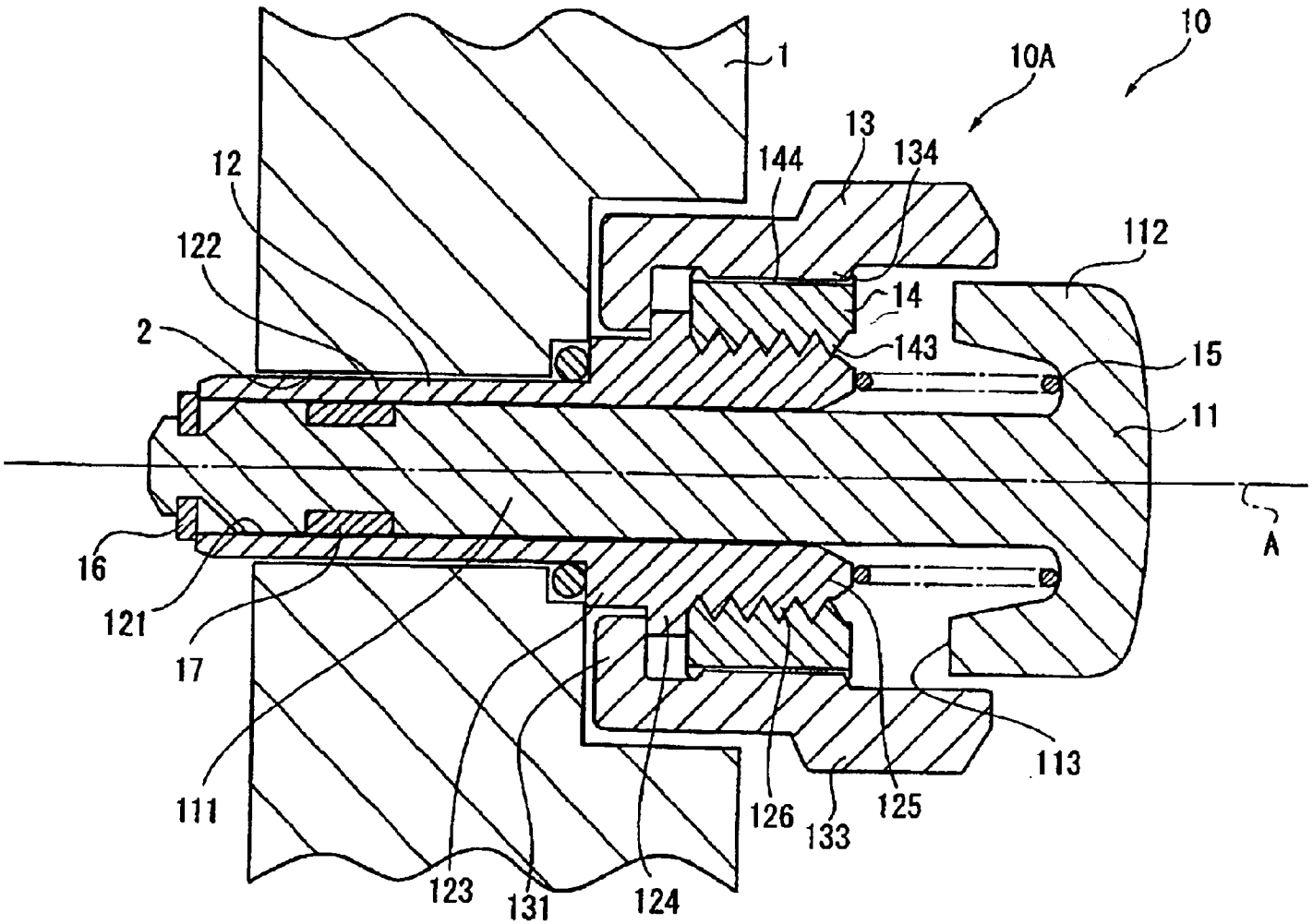
FIG. 8 is a cross-sectional view showing the operating button in accordance with a third embodiment of the present invention in an unlocked state.
Figure 9:
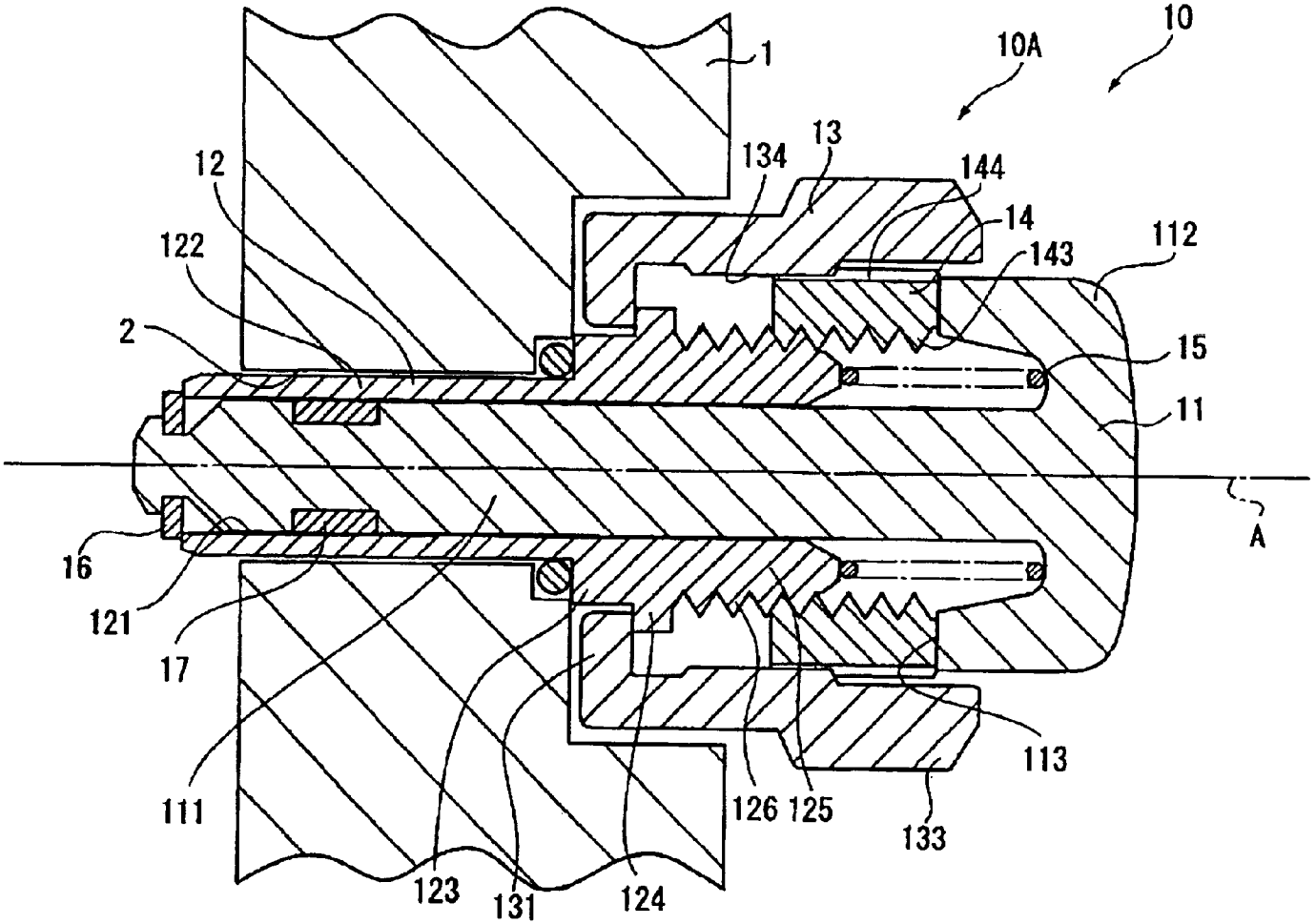
FIG. 9 is a cross-sectional view showing the locked state of the operating button.

Next, the button structure related to the third embodiment of the present invention is described based on FIGS. 8 and 9.

The button structure of the present invention has substantially the same configuration as the operating button 10 in the above-described first embodiment, but differs in terms of the threading and connecting relationships of the fixed member 12, the ring member 13, and the lock member 14. These differences are described in detail below.

FIGS. 8 and 9 are-cross-sectional views showing the operating button 10 and the unlocked and locked states, respectively.

In FIGS. 8 and 9, a guide portion 125 of the fixed member 12 is formed into a shape whose cross section is substantially cylindrical, and a threaded portion 126 that threadably engages the internal peripheral surface of the lock member 14 is formed on the external peripheral surface of the guide portion 125. A guide groove 134 that slidably engages the external peripheral surface of the lock member 14 in the internal-external direction along the axial center A in a manner that does not allow relative rotation is formed on the internal peripheral surface of the ring member 13. The guide groove 134 is a groove that is substantially concave in cross section and extends in the internal-external direction, and a plurality (four, for example) of these is disposed on the internal peripheral surface of the ring member 13. A threaded portion 143 that threadably engages the threaded portion 126 of the fixed member 12 is formed on the internal peripheral surface of the lock member 14, and a rail portion 144 that is substantially convex in cross section and engages the guide groove 134 of the ring member 13 is formed on the external peripheral surface of the lock member 14 in a corresponding relationship with the guide groove 134.

In the operating button 10 of the present embodiment configured as described above, the lock member 14 that is engaged with the guide groove 134 and the rail portion 144 is rotatably actuated along the external periphery of the guide portion 125 of the fixed member 12 by the rotating operation of the ring member 13. The lock member 14 is reciprocated in the internal-external direction along the axial center A by the engagement between the threaded portion 143 thereof and the threaded portion 126 of the fixed member 12. If the rotation of the ring member 13 is stopped, the movement of the lock member 14 is restricted by the engagement between the threaded portions 126 and 143.

The lock member 14 is allowed to move in this manner between the unlocked position (FIG. 8) in which the surface that corresponds to the internal end in the internal-external direction has made contact with the stopper portion 124 of the fixed member 12, and the locked position (FIG. 9) in which surface that corresponds to the external end has made contact with the contact surface 113 of the button member 11.

In addition to the above-described effects (1) to (6), the following effects are obtained in accordance with the present embodiment described above.

(13) The lock member 14 is rotatably moved along the threaded portion 126 of the fixed member 12 by the rotating operation of the ring member 13 as a result of the fact that the lock member 14 threadably engages the fixed member 12, and the rotating action of the lock member 14 is restricted by the ring member 13, so the movement in the internal-external direction of the lock member 14 can be reliably performed.

(14) By stopping the rotation of the ring member 13, the lock member 14 is caused to engage threadably the fixed member 12, so the engagement between the threaded portions 126 and 143 allows the movement of the lock member 14 to be reliably restricted, and the locked and unlocked states to be adequately maintained.

(Fourth Embodiment)

Figure 10:
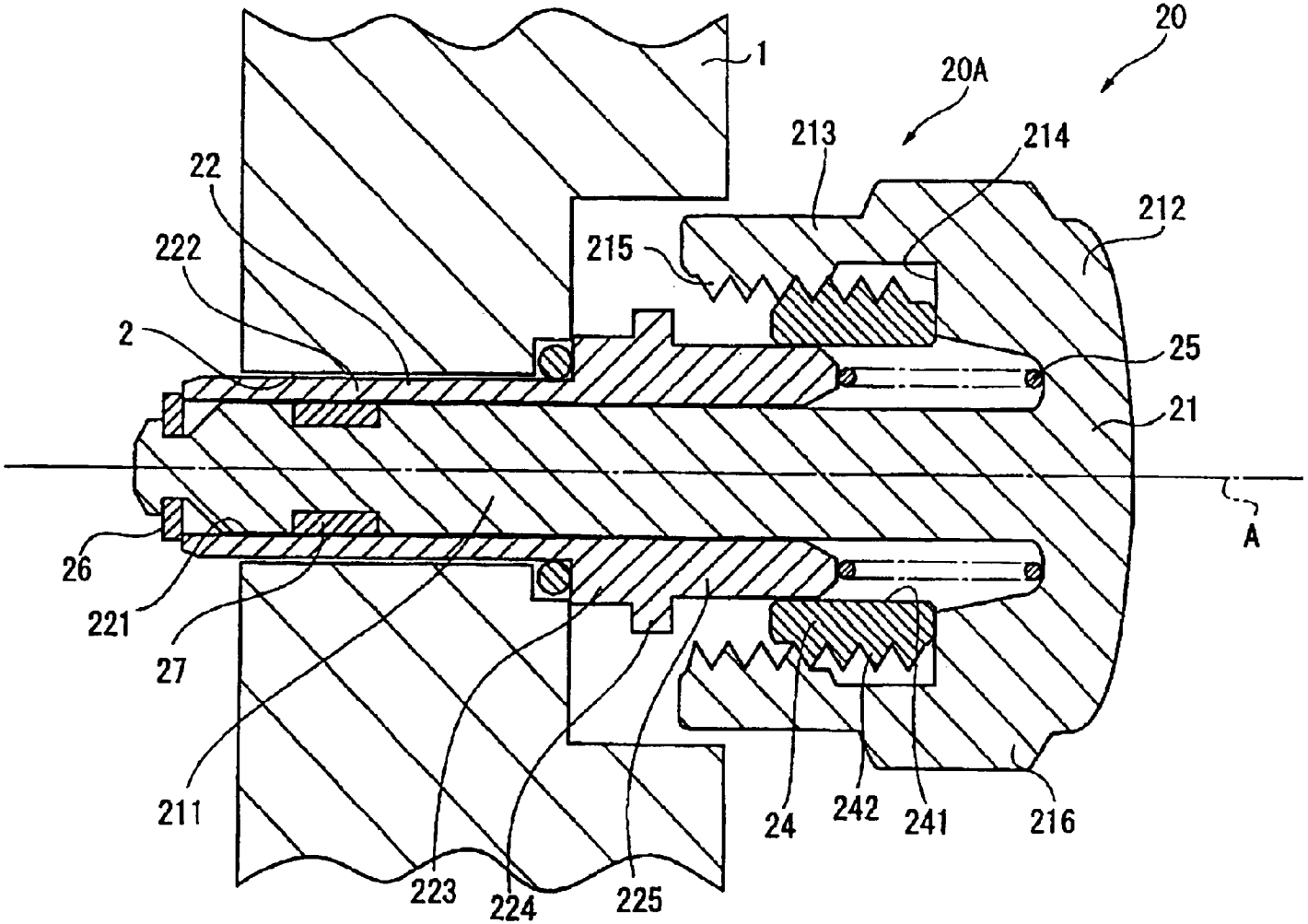
FIG. 10 is a cross-sectional view showing an operating button in accordance with a fourth embodiment of the present invention in an unlocked state.
Figure 11:
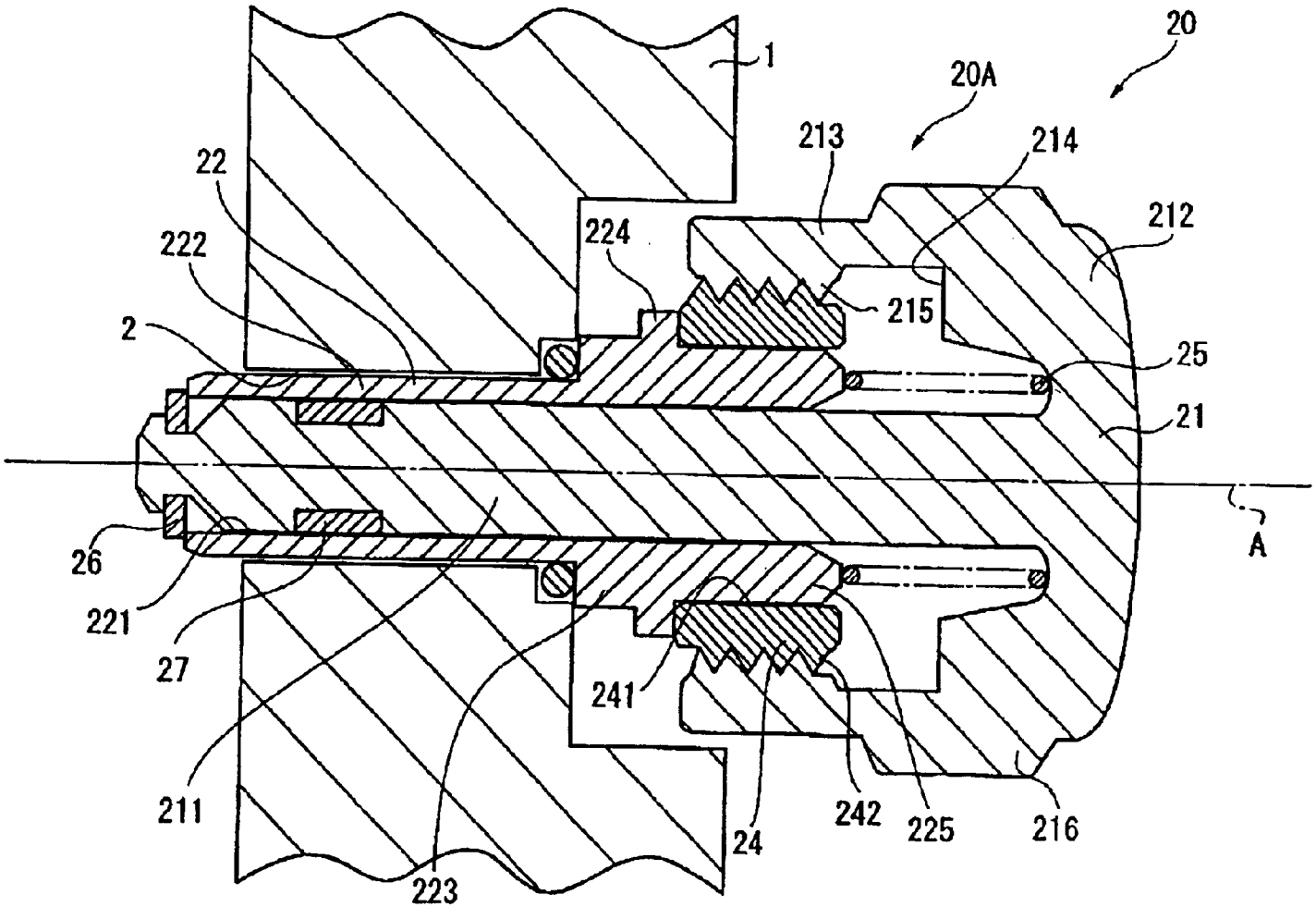
FIG. 11 is a cross-sectional view showing the locked state of the operating button.

Next, the button structure related to the fourth embodiment of the present invention is described based on FIGS. 10 and 11.

The button structure of the present invention has substantially the same configuration as the operating button 10 in the above-described first embodiment, but differs in terms of the structure and configuration thereof with respect to the button member 11 and the ring member 13 of the first embodiment. These differences are described in detail below.

FIGS. 10 and 11 are cross-sectional views showing an operating button 20 of the present invention and the locked and unlocked states, respectively.

The operating button 20 includes a button member 21 disposed such that rotation and reciprocation in the internal-external direction of the case 1 are permitted, a fixed member 22 fixed to the through-hole 2 of the case 1, and a lock member 24 disposed between the button member 21 and the fixed member 22. There is also a lock mechanism 20A for preventing the operating button 20 from being caused to malfunction by these members. The operating button 20 is further provided with a coil spring 25 that serves as an elastic member for urging the button member 21 in a direction to protrude from the case 1.

The button member 21 is formed having a long, cylindrically shaped shaft portion 211 rotatably disposed in a manner that allows entry and exit along the through-hole 2, a head portion 212 as an expanded-diameter portion in which the shaft diameter is expanded in the direction intersecting the axial center A on the external end along the axial center A of the shaft portion 211, and a cylindrically shaped portion 213 that is continuous on the external edge of the head portion 212 and is disposed around the shaft portion 211 next to the case 1. In other words, the cylindrically shaped portion 213 is enclosed by the head portion 212 on the side that constitutes the external end along the axial center A, and is formed with a substantially cylindrical shape that that is coaxial with the shaft portion 211. The contact surface 214 in contact with the lock member 14 is disposed on the head portion 112 facing the case 1.

The button member 21 may be configured such that the shaft portion 211, the head portion 212, and the cylindrically shaped portion 213 are integrally formed, or such that each of these are separately provided, or be formed in suitable combinations thereof. When the shaft portion 211, the head portion 212, and the cylindrically shaped portion 213 are separately made, it is possible to have a configuration whereby the head portion 212 and the cylindrically shaped portion 213 alone are rotationally operated if the head portion 212 and the cylindrically shaped portion 213 are axially supported by the shaft portion 211.

The cylindrically shaped portion 213 of the button member 21 has a substantially cylindrical shape having a internal diameter sufficient to allow the fixed member 22 and the lock member 24 to be inserted therein, and the side that constitutes the internal end in the internal-external direction is moved away from the case 1 by a predetermined distance equal to the length of entry due the pressing operation of the button member 21. Also, a threaded portion 215 that threadably engages the eternal peripheral surface of the lock member 24 is formed on the internal peripheral surface of the cylindrically shaped portion 213, and a knurl 216 serving as a brace during rotation operation is formed on the external peripheral surface of the cylindrically shaped portion 213.

The fixed member 22 is formed such that the entire member has a substantially cylindrical shape, and an insertion hole 221 extending in the internal-external direction along the through-hole 2 of the case 1 is formed in the lengthwise direction thereof. The shaft portion 211 of the button member 21 is inserted from the outside into the insertion hole 221, and a stopper pin 26 is mounted on the tip of the shaft portion 211 protruding into the case 1. The stopper pin 26 may, for example, be an E ring, and it is configured so as to prevent the button member 21 from slipping out by coming into contact with internal end of the fixed member 22 next to the case 1. A waterproofing seal material 27 is disposed between the insertion-hole 221 and the shaft portion 211.

The fixed member 22 has an insert 222 that is inserted into the through-hole 2, and the fixed member 22 is configured to be difficult to remove from the case 1 by press-fitting the fixed member 222 into the through-hole 2 with a predetermined pressing force. A fixed portion 223 with a shaft diameter greater than the internal diameter of the through-hole 2 is formed on the outside of the insert 222. This fixed portion 223 is fixedly soldered to the external end portion of the through-hole 2, the fixed member 22 is prevented from rotating about the axial center A by the fixed soldering, and water or the like is prevented from entering between the through-hole 2 and the insert 222. A stopper portion 224 with a shaft diameter greater than the fixed member 223 is formed on the outside of the fixed member 223. Furthermore, a guide portion 225 whose cross section is substantially an angular column is formed toward the external end of the fixed member 22 in the internal-external direction, and is configured to allow the lock member 24 to be guided in the internal-external direction along this guide portion 225.

The lock member 24 is formed in the shape of a ring as a whole, and an angular hole 241 formed in the internal peripheral surface thereof slidably engages with the guide portion 225 of the fixed member 22 in the internal-external direction. In other words, the rotational movement of the lock member 24 about the axial center A is restricted by engagement of the angular hole 241 thereof with the angular guide member 225 of the fixed member 22. A threaded portion 242 for threadably engaging the threaded portion 215 of the cylindrically shaped portion 213 of the button member 21 is formed on the external peripheral surface of the lock member 14. Therefore, mutual engagement of the threaded portions 215 and 242 causes the lock member 24 to move back and forth in the internal-external direction along the axial center A by the rotational operation of the button member 21, and if the rotation of the button member 21 is stopped, movement is restricted. The lock member 24 is capable of moving between the unlocked position (FIG. 10) in which the surface that corresponds to the internal end in the internal-external direction has been brought into contact with the contact surface 214 of the button member 21, and the locked position in which surface that corresponds to the external end has been brought into contact with the contact portion 224 of the fixed member 22 (FIG. 11).

The coil spring 25 is insertably mounted over the shaft portion 211 of the button member 21, one end making contact with the depressed portion of the concave shape of the head portion 212, and the other end making contact with surface that corresponds to the external end of the fixed member 22. The coil spring 25 is mounted in a predetermined compressed state, and is constantly urging the button member 21 in the direction away from the case 1. Furthermore, the assembly is configured so that pressing operation of the button member 21 compresses the coil spring 25 to generate a greater urging force, and the button member 21 is returned to its initial position by the urging force if the pressing operation is released.

The assembly procedure of the operating button 20 described above is described below.

First, the insert 222 of the fixed member 22 is press-fitted into the through-hole 2 of the case 1, and the fixed portion 223 and the external end portion of the through-hole 2 are fixed by soldering.

Next, the lock member 14 is set in a state in which the angular hole 241 thereof engages the guide portion 225 of the fixed member 22.

The shaft portion 211 of the button member 21 around which the coil spring 25 has been inserted is itself inserted into the insertion hole 221 of the fixed member 22, the button member 21 is pressed against the urging force of the coil spring 15 to cause the shaft portion 211 to protrude into the case 1, and the stopper pin 26 is mounted on the tip of the shaft portion 211.

The operating button 20 is mounted into the through-hole 2 of the case 1 with the procedure described above.

The following effects are obtained in accordance with the present embodiment described above.

(15) The lock member 24 configured to be capable of moving along the axial center A by rotating operation of the button member 21 is disposed on the inside of the cylindrically shaped member 213 of the button member 21, so the lock member 24 is not externally exposed, the external appearance of the operating button 20 does not change in the locked or unlocked state, and the design of the external appearance can be improved.

(16) The lock member 24 is not externally exposed, so foreign matter or the like does not enter the interior of the button member 21 in association with the movement of the lock member 24, ease of operation can be maintained, and maintenance requirements can be eased.

(17) The shaft portion 211 of the button member 21 is axially supported in the insertion hole 221 of the fixed member 22, and the tip of the shaft portion 211 is stopped by the stopper pin 26, so the button member 21 can be rotationally operated without rattling, and the lock member 24 can be smoothly moved.

(18) The cylindrically shaped portion 213 is integrally formed with the button member 21; in other words, the ring member 13 and the button member 11 in the above-described first embodiment are integrated to form the button member 21, so the perceived integral external appearance is enhanced, the design characteristics can be improved, and the number of components can be reduced.

(19) When the button member 21 is pressed and then released, the button member 21 immediately returns to its initial position because the button member 21 is urged by the coil spring 25, so the button can be operated with greater ease.

(20) The coil spring 25 does not vary in its extension and compression even if the lock member 24 moves, and the force required for rotating the button member 21 does not vary because the coil spring 25 is housed between the head portion 212 of the button member 21 and the fixed member 22, so the operability is improved.

(21) The lock member 24 threadably engages the internal periphery of the cylindrically shaped portion 213 of the button member 21, and the rotating operation of the lock member 24 is restricted by the fixed member 22, so the movement of the lock member 24 by the rotation of the button member 21 can be reliably performed.

(22) The lock member 24 threadably engages the internal periphery of the cylindrically shaped portion 213 of the button member 21, so if the rotation of the button member 21 is stopped, the movement of the lock member 24 can be reliably restricted and the locked and unlocked states can be adequately maintained due to the mutual engagement of the threaded portions 215 and 242.

(Fifth Embodiment)

Figure 12:
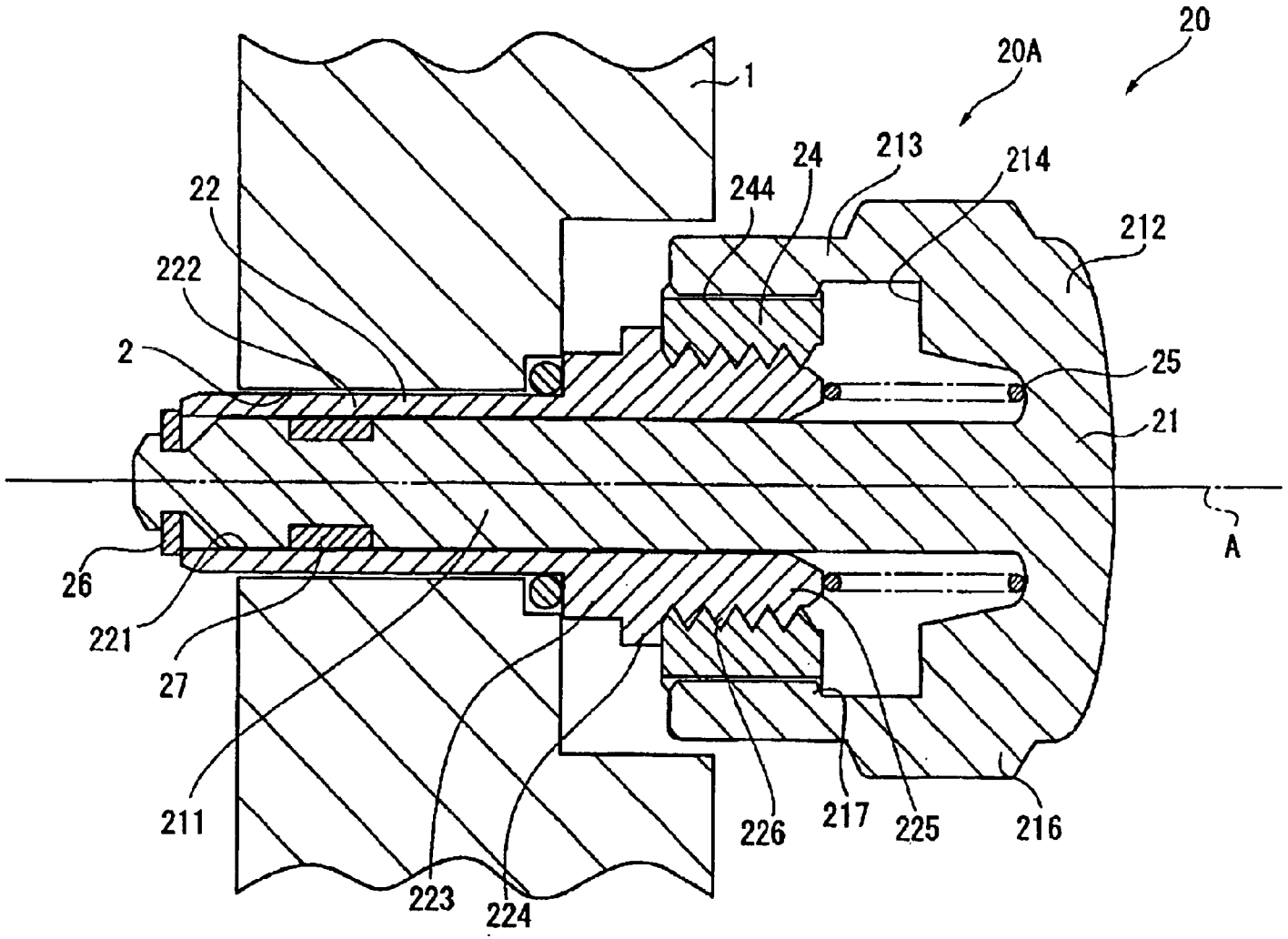
FIG. 12 is a cross-sectional view showing an operating button in accordance with an fifth embodiment of the present invention in an unlocked state.
Figure 13:
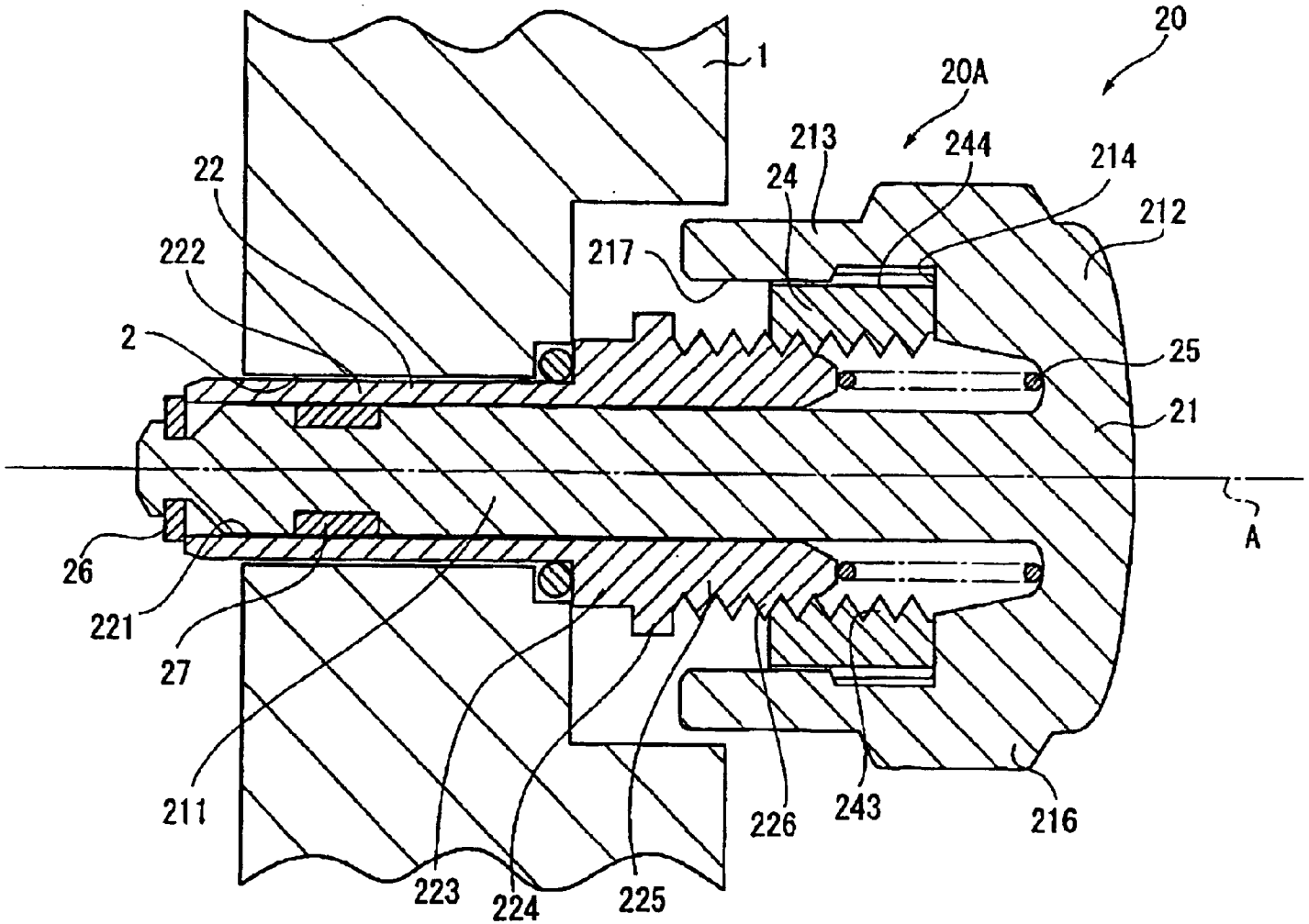
FIG. 13 is a cross-sectional view showing the locked state of the operating button.

Next, the button structure related to the fifth embodiment of the present invention is described based on FIGS. 12 and 13.

The button structure of the present invention has substantially the same configuration as the operating button 20 in the above-described fourth embodiment, but differs in terms of the threading and connecting relationships of the button member 21, the fixed member 22, and the lock member 24. These differences are described in detail below.

FIGS. 12 and 13 show the operating button 20, and are cross-sectional views respectively showing the unlocked and locked states.

In FIGS. 12 and 13, the guide portion 225 of the fixed member 22 is formed such that its cross section is substantially a cylindrical shape, and a threaded portion 226 for threadably engaging the internal peripheral surface of the lock member 24 is formed on the external peripheral surface of the guide portion 225. A guide groove 217 that slidably engages the external peripheral surface of the lock member 24 in the internal-external direction along the axial center A in a manner that does not allow relative rotation is formed on the internal periphery of the cylindrically shaped portion 213 of the button member 21. The guide groove 217 is a groove that is substantially concave in cross section and extends in the internal-external direction, and a plurality (four, for example) of these is disposed on the internal peripheral surface of the cylindrically shaped portion 213. A threaded portion 243 that threadably engages the threaded portion 226 of the fixed member 22 is formed on the internal peripheral surface of the lock member 24, and a rail portion 244 that is substantially convex in cross section and engages the guide groove 217 of the cylindrically shaped portion 213 is formed on the external peripheral surface of the lock member 24 in a corresponding relationship with the guide groove 217.

In the operating button 20 of the present embodiment configured as described above, the lock member 24 that is engaged with the guide groove 217 and the rail portion 244 is rotatably actuated along the external periphery of the guide portion 225 of the fixed member 22 by the rotating operation of the button member 21. The lock member 24 is reciprocated in the internal-external direction along the axial center A by the engagement between the threaded portion 243 thereof and the threaded portion 226 of the fixed member 22. If the rotation of the ring member 21 is stopped, the movement of the lock member 24 is restricted by the engagement between the threaded portions 226 and 243. The lock member 24 is allowed to move in this manner between the unlocked position (FIG. 12) in which the surface that corresponds to the internal end in the internal-external direction has made contact with the stopper portion 224 of the fixed member 22, and the locked position (FIG. 13) in which surface that corresponds to the external end has made contact with the contact surface 214 of the button member 21.

In addition to the above-described effects (11) to (16), the following effects are obtained in accordance with the present embodiment described above.

(23) The lock member 24 threadably engages the fixed member 22, and the rotating operation of the lock member 24 is restricted by the cylindrically shaped portion 213 of the button member 21, so the movement of the lock member 24 in the internal-external direction can be reliably performed because the lock member 24 rotationally operates along the threaded portion 226 of the fixed member 22 due to the rotating operation of the button member 21.

(24) The lock member 24 threadably engages the fixed member 22, so if the rotation of the lock member 21 is stopped, the movement of the lock member 24 can be reliably restricted and the locked and unlocked states can be adequately maintained due to the mutual engagement of the threaded portions 226 and 243.

In the embodiments described above, for example, the button members 11 and 21 are urged in the direction protruding from the case 1 by the coil springs 15 and 25, and include the operating buttons 10 and 20 as press buttons for pressing operation, but the present invention is not limited to this arrangement alone and may be configured to allow a pulling operation. In this case, adopting the configuration of the operating button 10 in the first and second embodiments described above enables a configuration whereby time setting operations and other predetermined operations, for example, can be performed by rotationally operating the button member about the axial center.

In the first, second, and fourth embodiments described above, the angular holes 141 and 241 of the lock members 14 and 24 engage the substantially angular columnar guide member 125 of the fixed members 12 and 22 to restrict the rotational action of the lock members 14 and 24, but the present invention is not limited to this arrangement alone, and a guide groove may be formed on the internal surface of the lock member or the external surface of the guide portion facing the each other, and a projection, a guide rail, or the like may be formed on the other surface as a way of restricting rotational action.

In the third and fifth embodiments described above, the rail portions 144 and 244 of the lock members 14 and 24 engage the guide grooves 134 and 217 of the ring member 13 and the button member 21 to restrict the rotational action of the lock members 14 and 24, but the present invention is not limited to this arrangement alone, and the external surface of the lock member and the internal surface of the ring member or the internal surface of the cylindrically shaped portion of the button member, which face each other, may be formed with a polygonal shape as a way of restricting rotational action.

In the embodiments described above, the fixed members 12 and 22 are fixed to the case 1, and the lock members 14 and 24 engage or threadably engage the guide portions 124 and 225 of the fixed members 12 and 22, but the present invention is not limited to this arrangement alone, and a portion of the case may protrude toward the outside, and the guide portion may be formed in this protruding portion. If the configuration of the operating button 10 in the first and second embodiments described above is adopted, the lock member case can be moveably and nonrotatably supported because the guide portion of the fixed member and the case are omitted, the guide portion is disposed in the shaft portion of the button member, and the lock member is engaged therein.

In the first and second embodiments described above, the stopped portion 131 of the ring member 13 is stopped between the case 1 and the stopper portion 124 of the fixed member 12, but the present invention is not limited to this arrangement alone, and also possible is a configuration whereby the fixed member alone is used for stopping, or a configuration whereby the case alone is used for stopping.

In the embodiments described above, the contact surfaces 113 and 214 that are in contact with the lock members 14 and 24 are disposed in one portion of the head portions 112 and 212 formed on the external end in the internal-external direction of the button members 11 and 21, but the present invention is not limited to this arrangement alone, and also possible is a configuration whereby an expanded-diameter portion is formed in an intermediate position of the shaft portion of the button member, and the expanded-diameter portion and the lock member make contact with each other. In this case, if the configuration of the operating button 10 in the first and second embodiments described above is adopted, the head portion of the button member is not required to have a shaft diameter that is greater than the shaft portion, and it is possible to adopt a configuration whereby the head portion is formed to about the same size as the shaft portion, and an insertion hole capable of accommodating the head portion is formed in the ring member, for example.

In the embodiments described above, the lock members 14 and 24 are formed into the shape of a ring, but the present invention is not limited to this arrangement alone, and any shape is possible as long as it has a predetermined threaded portion and a rotation restricting portion, and may have a plurality of members, for example.

In the embodiments described above, the coil springs 15 and 25 are disposed between the head portions 112 and 212 of the button members 11 and 21 and the fixed members 12 and 22, but the present invention is not limited to this arrangement alone, and an elastic member may be disposed between the shaft portion and the fixed member, between the shaft portion and the case, or in other locations.

In the embodiments described above, the operating buttons 10 and 20 may have a position indicator whereby it can be externally confirmed whether the lock members 14 and 24 are in the locked or unlocked position. This position indicator may be configured with an indicator hole formed in the cylindrically shaped portion of the ring member or button member, and a mark or the like disposed on a portion of the lock member corresponding to the indicator hole. In other words, the position of the lock member that moves relative to the cylindrically shaped portion of the ring member or button member may be one in which the operating button can be confirmed from the outside. By adopting such a configuration, the locked and unlocked states can be easily confirmed, and the advantages and convenience can be enhanced.

In the third embodiment described above, the locked state indicator 145 described in the second embodiment may be disposed on the lock member 14. By adopting such a configuration, the same advantageous effects as (9) to (11) described above can be achieved in the operating button 10 of the third embodiment.

The locked state indicator is not limited to one in which a portion of the lock member protrudes toward the head portion of the button member, and also possible is a configuration whereby a portion of the lock member is passed through the head portion of the button member and the ring member to allow external visual confirmation. A locked state indicator with such a configuration may be applied to the operating button of the fourth and fifth embodiments described above.

The spring member 18C, and the packing materials 18A and 18B serving as restricting members described in the second embodiment may also be provided to the third to fifth embodiments described above. In other words, the packing materials and the spring member in the operating button 10 of the third embodiment may be disposed between the case 1 and the external peripheral surface of the ring member 13, between the case 1 and the bottom surface of the ring member 13, between ring member 13 and the fixed member 12, between the ring member 13 and the lock member 14, between the lock member 14 and the fixed member 12, or in other locations. Also, the packing materials and the spring member in the operating button 20 of the third and fourth embodiments may be disposed between the case 1 and the cylindrically shaped portion 213 of the button member 21, between the cylindrically shaped portion 213 of the button member 21 and the lock member 24, between the lock member 24 and the fixed member 22, or in other locations. By adopting such a configuration, the same advantageous effects as (12) described above can be achieved in the operating button of the third to fifth embodiments.

The terms "front," "back, "up," "down," "perpendicular," "horizontal," "diagonal," and other direction-related terms used above indicate the directions in the diagrams used herein.

Therefore, the direction-related terms used to describe the present invention should be interpreted in relative terms as applied to the diagrams used.

"Substantially," "essentially," "about," and other approximation-indicating terms used above represent a reasonable amount of deviation that does not bring about a considerable change as a result. Terms that represent these approximations should be interpreted so as to include an error of about ±5% at least, as long as there is no considerable change due to the deviation.

The entire disclosure in Japanese Patent Application (Tokugan) 2003-097495 is incorporated in this specification by reference.

The embodiments described above constitute some of the possible embodiments of the present invention, and it is apparent to those skilled in the art that it is possible to add modifications to the above-described embodiments by using the above-described disclosure without exceeding the range of the present invention as defined in the claims. The above-described embodiments furthermore do not limit the range of the present invention, which is defined by the accompanying claims or equivalents thereof, and are only designed to provide a description of the present invention.

What is claimed is:

1. A button capable of entry and exit with respect to a base, said button comprising:

a button member having a shaft portion mounted in a manner that allows entry and exit with respect to the base, and an expanded-diameter portion with a shaft diameter that is larger than the diameter of the shaft portion;

a ring member with the shaft portion inserted therethrough, capable of rotating about the axial center of the shaft portion;

a lock member that is caused to move along the axial center between the ring member and the shaft portion by the rotation of the ring member, and that restricts the entry and exit action of the button member by coming into contact with the expanded-diameter portion of the button member; and a fixed member fixed to the base, for stopping the ring member to restrict the movement of the ring member along the axial center.

2. The button according to claim 1, wherein the lock member has a hole through which the shaft portion is inserted in a manner that allows relative movement along the axial center but does not allow relative rotation about the axial center, and an external periphery in threadable engagement with the ring member.

3. The button according to claim 2, wherein the fixed member comprises an insert that is press-fitted into the base along the shaft portion of the button member, and a stopper portion for stopping the ring member.

4. The button according to claim 1, wherein the lock member has a hole for threadably engaging the fixed member, and an external peripheral portion for engaging the ring member in a manner that allows relative movement along the axial center but does not allow relative rotation about the axial center.

5. The button according to claim 1, wherein the lock member has a locked state indicator that is exposed from between the expanded-diameter portion and the ring portion in a state wherein the entry and exit action of the button member is restricted.

6. The button according to claim 1, further comprising a restricting member for restricting the rotational movement of the ring member and/or the rotating or reciprocating movement of the lock member, disposed in at least one location between the ring member and the fixed member, between the ring member and the lock member, and between the lock member and the base or the fixed member.

7. The button according to claim 6, wherein the restricting member comprises a packing material.

8. The button according to claim 6, wherein the restricting member comprises a spring member.

9. The button according to claim 1, further comprising an elastic member disposed between the button member and the base, to urge the button member in the direction protruding from the base.

10. The button according to claim 9, wherein the elastic member is disposed between the expanded-diameter portion of the button member and the fixed member.

11. Portable equipment comprising:

a portable equipment main body; and a button capable of entry and exit with respect to the portable equipment main body, said button including a button member having a shaft portion mounted in a manner that allows entry and exit with respect to the base and an expanded-diameter portion with a shaft diameter that is larger than the diameter of the shaft portion, a ring member with the shaft portion inserted therethrough, capable of rotating about the axial center of the shaft portion, a lock member that is caused to move along the axial center between the ring member and the shaft portion by the rotation of the ring member and that restricts the entry and exit action of the button member by coming into contact with the expanded-diameter portion of the button member, and a fixed member fixed to the portable equipment main body, for stopping the ring member so as to restrict the movement of the ring member along the axial center.

12. A button capable of entry and exit with respect to a base, said button comprising:

a button member having a shaft portion mounted in a manner that allows entry and exit with respect to the base, an expanded-diameter portion with a shaft diameter that is larger than the diameter of the shaft portion, and a cylindrically shaped portion that extends to the external end of the expanded-diameter portion and is disposed surrounding the shaft portion;

a lock member having an internal peripheral portion through which the shaft portion is inserted in a manner that allows relative movement along the axial center of the shaft portion between the shaft portion and the cylindrically shaped portion, and an external peripheral portion that threadably engages the internal periphery of the cylindrically shaped portion of the button member; and a fixed member that is fixed to the base and supports the lock member in a manner that allows relative movement along the axial center but does not allow relative rotation about the axial center, wherein the entry and exit action of the button member is restricted such that the lock member moves along the axial center due to the rotation of the button member, and the lock member makes contact therewith.

13. The button according to claim 12, further comprising a restricting member to restrict the rotational movement of the button member and/or the rotating or reciprocating movement of the lock member, disposed in at least one location between the cylindrically shaped portion and the fixed member, between the cylindrically shaped portion and the lock member, and between the lock member and the fixed member.

14. The button according to claim 13, wherein the restricting member comprises a packing material.

15. The button according to claim 12, further comprising an elastic member disposed between the button member and the base, to urge the button member in the direction protruding from the base.

16. The button according to claim 15, wherein the elastic member is disposed between the expanded-diameter portion of the button member and the fixed member.

17. Portable equipment comprising:

a portable equipment main body; and a button capable of entry and exit with respect to the portable equipment main body, said button comprising a button member having a shaft portion mounted in a manner that allows entry and exit with respect to the portable equipment main body, an expanded-diameter portion with a shaft diameter that is larger than the diameter of the shaft portion, and a cylindrically shaped portion that extends to the external end of the expanded-diameter portion and is disposed surrounding the shaft portion, a lock member having an internal peripheral portion through which the shaft portion is inserted in a manner that allows relative movement along the axial center of the shaft portion between the shaft portion and the cylindrically shaped portion, and an external peripheral portion that threadably engages the internal periphery of the cylindrically shaped portion of the button member, and a fixed member that is fixed to the base and supports the lock member in a manner that allows relative movement along the axial center but does not allow relative rotation about the axial center, wherein the entry and exit action of the button member is restricted such that the lock member moves along the axial center due to the rotation of the button member, and the lock member makes contact therewith.

18. A button capable of entry and exit with respect to a base, said button comprising:

a button member having a shaft portion mounted in a manner that allows entry and exit with respect to the portable equipment main body, an expanded-diameter portion with a shaft diameter that is larger than the diameter of the shaft portion, and a cylindrically shaped portion that extends to the external end of the expanded-diameter portion and is disposed surrounding the shaft portion;

a lock member having an internal peripheral portion through which the shaft portion is inserted in a manner that allows relative movement along the axial center of the shaft portion between the shaft portion and the cylindrically shaped portion, and an external peripheral portion that threadably engages the internal periphery of the cylindrically shaped portion of the button member; and a fixed member that is fixed to the base and supports the lock member in a manner that allows relative movement along the axial center but does not allow relative rotation about the axial center, wherein the entry and exit action of the button member is restricted such that the lock member moves along the axial center due to the rotation of the button member, and the lock member makes contact therewith.

19. The button according to claim 18, further comprising a restricting member to restrict the rotational movement of the button member and/or the rotating or reciprocating movement of the lock member, disposed in at least one location between the cylindrically shaped portion and the fixed member, between the cylindrically shaped portion and the lock member, and between the lock member and the fixed member.

20. The button according to claim 18, wherein the restricting member comprises a packing material.

21. The button according to claim 18, further comprising an elastic member disposed between the button member and the base, to urge the button member in a direction protruding from the base.

22. The button according to claim 21, wherein the elastic member is disposed between the expanded-diameter portion of the button member and the fixed member.

23. Portable equipment, comprising:

a portable equipment main body; and a button comprising a button member having a shaft portion mounted in a manner that allows entry and exit with respect to the base, an expanded-diameter portion with a shaft diameter that is larger than the diameter of the shaft portion, and a cylindrically shaped portion that extends to the external end of the expanded-diameter portion and is disposed surrounding the shaft portion, a lock member having an internal peripheral portion through which the shaft portion is inserted in a manner that allows relative movement along the axial center of the shaft portion between the shaft portion and the cylindrically shaped portion, and an external peripheral portion that is disposed in a manner that allows relative movement along the axial center with respect to the cylindrically shaped portion of the button member but does not allow relative rotation, a fixed member that is fixed to the base and threadably engages the external peripheral portion of the lock member, wherein the fixed member restricts the entry and exit action of the button member such that the lock member moves along the axial center due to the rotation of the button member, and the lock member makes contact therewith.

* * * * *